US006749800B2

(12) United States Patent
Müller-Ziller et al.

(10) Patent No.: US 6,749,800 B2
(45) Date of Patent: Jun. 15, 2004

(54) ARRANGEMENT AND METHOD FOR TRANSPORTING METALLIC WORK PIECES, AND SYSTEM FOR HEAT TREATMENT OF SAID WORK PIECES

(75) Inventors: Jörg Müller-Ziller, Tönisvorst (DE); Franz Bless, Kleve (DE)

(73) Assignee: Ipsen International GmbH (DE)

( * ) Notice: Subject to any disclaimer, the term of this patent is extended or adjusted under 35 U.S.C. 154(b) by 0 days.

(21) Appl. No.: 10/056,578

(22) Filed: Jan. 25, 2002

(65) Prior Publication Data

US 2002/0146659 A1 Oct. 10, 2002

(30) Foreign Application Priority Data

Jan. 26, 2001 (EP) ..... 01101852

(51) Int. Cl.[7] ..... C21D 1/74
(52) U.S. Cl. ..... 266/250; 432/138
(58) Field of Search ..... 266/250, 249; 432/121, 138

(56) References Cited

U.S. PATENT DOCUMENTS

| | | | | |
|---|---|---|---|---|
| 1,876,960 A | | 9/1932 | Kenworthy | |
| 2,446,403 A | | 8/1948 | Bassereau | |
| 3,014,708 A | | 12/1961 | Helin | |
| 5,052,923 A | | 10/1991 | Peter et al. | |
| 5,402,994 A | | 4/1995 | Egger | |
| 5,567,381 A | | 10/1996 | Carter | |
| 5,624,255 A | * | 4/1997 | Hisada et al. | 432/128 |
| 5,722,825 A | * | 3/1998 | Edenhofer | 432/138 |
| 6,065,964 A | | 5/2000 | Pelissier | |

FOREIGN PATENT DOCUMENTS

| | | |
|---|---|---|
| DE | 32 42 418 | 5/1983 |
| DE | 4316841 | 11/1994 |
| EP | 0 893 510 | 1/1999 |
| EP | 1071117 A2 * | 1/2001 |
| FR | 2 782 156 | 2/2000 |
| FR | 2 771 754 | 5/2000 |

* cited by examiner

*Primary Examiner*—Scott Kastler
(74) *Attorney, Agent, or Firm*—Cantor Colburn LLP

(57) ABSTRACT

An arrangement for transporting metallic work pieces includes a heat-insulated transport chamber, means for loading and unloading the work pieces, and transporting gear. To enable the flexible and efficient transport of the work pieces among a number of treatment chambers in an arrangement of this type during a heat treatment process, the transport chamber is designed to be vacuum-tight, such that it can be evacuated of air to create a vacuum that will protect the work pieces from environmental influences.

In addition, a system for heat treating metallic work pieces, comprising at least two treatment chambers in which the work pieces can be heat treated, is characterized in that an arrangement of this type can be coupled to the treatment chambervia a transfer canal that can be evacuated.

Furthermore, in a method for transporting metallic work pieces during a heat treatment process, a vacuum-tight transport chamber is evacuated to create a vacuum that will protect the work pieces from environmental influences, for the purpose of transporting the work pieces within this vacuum from one treatment chamber to the next.

17 Claims, 3 Drawing Sheets

ARRANGEMENT AND METHOD FOR TRANSPORTING METALLIC WORK PIECES, AND SYSTEM FOR HEAT TREATMENT OF SAID WORK PIECES

FIELD OF THE NVENTION

The invention relates to an arrangement for transporting metallic work pieces, especially during a heat treatment process, which is equipped with a heat-insulated transport chamber designed to hold the work pieces, means for loading and unloading the work pieces, and transporting gear for moving the transport chamber. The invention further relates to a system for heat treating metallic work pieces, which is equipped with at least two treatment chambers in which the work pieces may be heat treated. Furthermore, the invention involves a method for transporting metallic work pieces during a heat treatment process, in which the work pieces are transported within a heat-insulated transport chamber between at least two treatment chambers in which the work pieces may be heat-treated.

DESCRIPTION OF THE RELATED ART

In order to generate specific properties for work pieces, such as a high degree of hardness or a high capacity of resistance to wear, metallic work pieces are usually subjected to a thermal or thermochemical heat treatment process. The heat treatment alters the microstructure of the work pieces, lending them the desired properties. In addition to the general processing parameters of pressure, temperature, and duration of treatment, the atmosphere in which the heat treatment is conducted is of particular importance to the outcome of the treatment. A number of processes are known in the art by which work pieces can be exposed to various atmospheres in order to obtain the desired treatment results. In such processes the work pieces are carried, one after another, to a plurality of treatment chambers in a heat treatment system. The individual treatment chambers are ordinarily connected to one another via a transfer canal, which serves to protect the work pieces during transport from environmental influences that could produce undesirable effects on the treatment results achieved up to that point. To this end, the transfer canal can be either filled with a protective atmosphere, such as is known, for example, from DE-A-43 16 841, or evacuated of air, such as is proposed in FR-A-2 771 754.

The disadvantage of transfer canals of this type is that the configuration of the course of the heat treatment system can be varied to only a limited extent. Further, dismantling such heat treatment systems is relatively costly, even in cases involving modular construction such as is known from FR-A-2 771 754. In terms of economy, it is also most unsatisfactory that maintenance work on individual treatment chambers, and especially on the conveyor car in the transport canal, necessarily requires the temporary shutdown of the entire heat treatment system.

Further, from U.S. Pat. No. 5,567,381 a heat-treatment system is known which is equipped with a vacuum furnace, a transfer canal, and a movable transport chamber. The transport chamber can be coupled to the vacuum furnace via the transfer canal. The transport chamber, which is heat-insulated from the outside and is equipped with a hermetically sealed door, is further equipped with a heating unit for heating the work pieces, and a lifting device for loading and unloading the work pieces. To transfer the work pieces, which have been heated to a certain temperature in the vacuum furnace, to a further treatment chamber, such as a quenching chamber, the transport chamber is coupled to the transfer canal and preheated. Both the transfer canal and the transport chamber are then flooded with an inert gas, until they reach a pressure that is greater than the ambient pressure, in order to prevent air from entering the transfer canal or the transport chamber from the outside. The work pieces in the vacuum furnace are then cooled to the temperature prevailing in the transport chamber, and the vacuum furnace is flooded with an inert gas. When the same pressure level has been reached in the vacuum furnace and in the transfer canal or transport chamber, the door of the vacuum furnace is opened, and the work pieces are loaded inside via the lifting device that is part of the transport chamber.

With the transport chamber described above, it is possible to transport heated work pieces from one treatment chamber to the next while exposing them to an atmosphere of inert gas, thus preventing an undesirable oxidation of the work pieces. Although the heat treatment system described in U.S. Pat. No. 5,567,381 offers a greater degree of flexibility than the heat treatment systems discussed above involving a stationary transfer canal, it carries with it the disadvantage that in coupling the transport chamber to the vacuum furnace, the transport chamber, the transfer canal, and the vacuum furnace are all flooded with the inert gas. Apart from the fact that providing the inert gas for such a system is highly costly, the inert gas also presents an obstacle to a continuous heat treatment process during transport of the work pieces from treatment chamber to treatment chamber. This is because the change in the atmosphere in the vacuum furnace triggered by the unavoidable flooding of the furnace with inert gas not only presupposes the conclusion of the heat treatment process in the vacuum furnace, but also is unavoidably connected with a cooling of the work pieces, due to the fact that the protective gas is not preheated. The latter is most disadvantageous for high-temperature heat treatment processes, in which, as a rule, no notable temperature fluctuations can be permitted.

SUMMARY OF THE INVENTION

The object of the invention is to provide an arrangement and a method for transporting metallic work pieces, and a system for heat treating these work pieces, which will enable a comparatively flexible and efficient transport of the work pieces among a plurality of treatment chambers during a heat treatment process.

This object is attained in accordance with the invention in an arrangement having the characteristic features described above, in that the transport chamber is designed to be vacuum-tight and can be evacuated of air to create a vacuum that will protect the work pieces from environmental influences.

An arrangement of this design, in comparison to the prior art stationary transfer canals, enables the flexible transport of the work pieces during a heat treatment process. For example, individual treatment chambers in a heat treatment system can be excluded from the process cycle to allow maintenance or repair work, without the other treatment chambers being involved. Further, with the arrangement specified in the invention, existing heat treatment systems can be expanded to include additional treatment chambers, without great expense.

Furthermore, this type of arrangement enables a considerably more efficient process due to the fact that, rather than flooding with inert gas, a vacuum is created in the transport chamber in order to protect the work pieces from undesirable environmental influences, such as oxidation caused by the introduction of oxygen. In contrast to the movable transport chamber specified in U.S. Pat. No. 5,567,381, with the arrangement specified in the invention it is possible to continue the heat treatment process inside the transport chamber during the transport of the work pieces from one treatment chamber to the next, without any noticeable change in temperature. In addition to the time that is saved with such an arrangement, providing an economic advantage, the arrangement is further characterized by its particular suitability for use with high-temperature heat treatment processes.

It is especially advantageous for the arrangement to be equipped with a vacuum pump for evacuating the air from the transport chamber. This offers the advantage that the arrangement is self-sufficient in terms of the evacuation of the transport chamber, and is thus not dependent upon the specific design of the treatment chambers. The transport chamber can thus dock, for example, with both vacuum furnaces and atmospheric furnaces, or with cooling chambers. Furthermore, providing the arrangement with a vacuum pump makes it possible for the transport chamber to be evacuated during the transport process. This comes to bear, for example, when, during the transfer of the work pieces from a treatment chamber into the transport chamber, the atmosphere prevailing in the treatment chamber is allowed to expand into the transport chamber in order to continue the heat treatment process in this atmosphere during the transport process, until shortly before it reaches the next treatment chamber.

It is further advantageous for the transport chamber to be heated. Although the heat insulation of the transport chamber already serves to counterbalance a drop in the temperature of the work pieces, which is generally sufficient over short transport distances, in cases of high-temperature heat treatment it may be necessary to use additional heat to hold the work pieces at the desired temperature. In this connection, it has proven highly expedient for the transport chamber to be provided with a removable thermal insulation, preferably made of steel. This type of insulation, made of chrome nickel steel, for example, can be easily removed to allow maintenance and repair work to be done. It offers the further advantage that, due to its low heat retention properties, the temperature of the transport chamber can be adjusted within only a few minutes, in other words it can be easily adjusted to the different temperatures of a number of treatment chambers.

In one particularly advantageous further development of the arrangement specified in the invention, the transport chamber is provided with a hermetically sealed loading door, which can be actuated via a drive mechanism, in order to ensure the self-sufficient docking of the transport chamber with a treatment chamber. Taking into account the disruptions that occur during regular operation, it can further be advantageous for the transport chamber to be provided with a hermetically sealable connecting door. By means of an external lifting device, for example, the transport chamber can then be unloaded through the connecting door, independent of the loading door, which under certain circumstances may not be freely accessible.

An extremely advantageous design for the arrangement specified in the invention is provided when the transport chamber and the transporting gear can be moved relative to one another. This arrangement makes it possible, in a simple manner, for the path of travel to be largely decoupled from the arrangement of the individual treatment chambers, making it dependent primarily upon the given operating conditions. In this connection, it has proven especially effective for the transport chamber to pivot horizontally, or to be arranged such that it can move in a straight line in a horizontal and/or vertical direction. The latter variation would be used, for example, in cases in which several treatment chambers are positioned vertically, one on top of another.

With respect to the effortless docking of the transport chamber to the treatment chambers, the loading ends of which may be oriented differently, it can be helpful, as an alternative or as a supplement to this, for the drive mechanism to be designed to enable a stationary rotation of the arrangement. In this case, for example, if the treatment chambers are positioned on both sides of a heat treatment path vis-a-vis their loading ends, it is sufficient for the transport chamber to be equipped with only one loading door, thus providing an economic advantage. The drive mechanism is preferably track-bound based upon operative requirements, or is freely controllable via induction loops embedded in the base. To achieve a comfortable loading of the work pieces from a treatment chamber into the transport chamber, or vice-versa, it has further proven advantageous for the device used to load and unload the work pieces to be equipped with a loading fork that can be moved horizontally and vertically.

To attain the above object involving a system for the heat treatment of metallic work pieces having the above-mentioned characterizing features, it is proposed that an arrangement in accordance with one of the claims 1 through 11 be coupled to the treatment chamber via a transfer canal from which the air can be evacuated.

A heat treatment system of this type capitalizes on the advantages offered by the above-described arrangement for transporting metallic work pieces. The inclusion of the transfer canal ensures that the work pieces can be transported between a treatment chamber and the transport chamber, protected from any environmental influences. The heat treatment system specified in the invention is characterized by a high degree of flexibility in terms of the transport of the work pieces between the individual treatment chambers, whereby a relatively high transfer rate and thus an economically efficient process can be achieved.

To ensure a highly compact and relatively lightweight design for the transport chamber, it is expedient to place the transfer canal on the treatment chamber, in a stationary position. Thus, each treatment chamber is provided with a transfer canal. In general, however, the transfer canal may also be designed as an integrated component of the transport chamber, or may be mobile. Although the latter embodiment is associated with higher construction costs, it makes sense to employ such a design when the heat treatment system is comprised of a large number of treatment chambers with long residence times for the work pieces, so that a mobile transfer canal can be used for a number of treatment chambers without problems with time constraints.

It is further expedient if the transfer canal can be evacuated of air, so that it can be operated independent of the treatment chamber being used, whether via a vacuum furnace or an atmospheric furnace. Further, with such a design it is possible for the transfer canal to be evacuated during the conveyance of the transport chamber to the corresponding treatment chamber, thus ensuring the most rapid process possible. Depending upon the specific application, however, it is also possible for the transfer canal to be evacuated via a vacuum pump that is part of the transport chamber. In one particularly advantageous embodiment of the system specified in the invention, the transfer canal is equipped with a drive mechanism for actuating the loading door of the transport chamber. This results in a particularly lightweight embodiment of the transport chamber, and thus relatively low costs for transporting the work pieces between the individual treatment chambers. With respect to the greatest possible variability in the design of the heat treatment system, the treatment chamber is expediently a vacuum furnace, an atmospheric furnace, or a cooling chamber.

In process terms, the above-mentioned object is attained with a method having the above-mentioned features, characterized in that the vacuum-tight transport chamber is evacuated to create a vacuum that will protect the work pieces from environmental influences, and the work pieces are transported within this vacuum from one treatment chamber to the next.

The transport of the work pieces within a transport chamber that has been evacuated to create a vacuum has proven most advantageous for the transport of work pieces that have been heated to a relatively high temperature, for example, 1,000° C. In contrast to the current state-of-the-art in which work pieces are transported in an atmosphere of inert gas, this type of system serves to prevent a frequently undesirable drop in temperature. In a further development of the method specified in the invention it is further proposed that the transport chamber be coupled to the given treatment chamber via a transfer canal, to capitalize on the advantages described above. Finally, it is proposed that the transfer canal be evacuated separately, in order to ensure a continuous coupling of the transport chamber.

BRIEF DESCRIPTION OF THE DRAWINGS

Details and further advantages of the object of the present invention are to be found in the following description of a preferred exemplary embodiment. The attached diagrams illustrate the following.

DETAILED DESCRIPTION

Figure 1A:
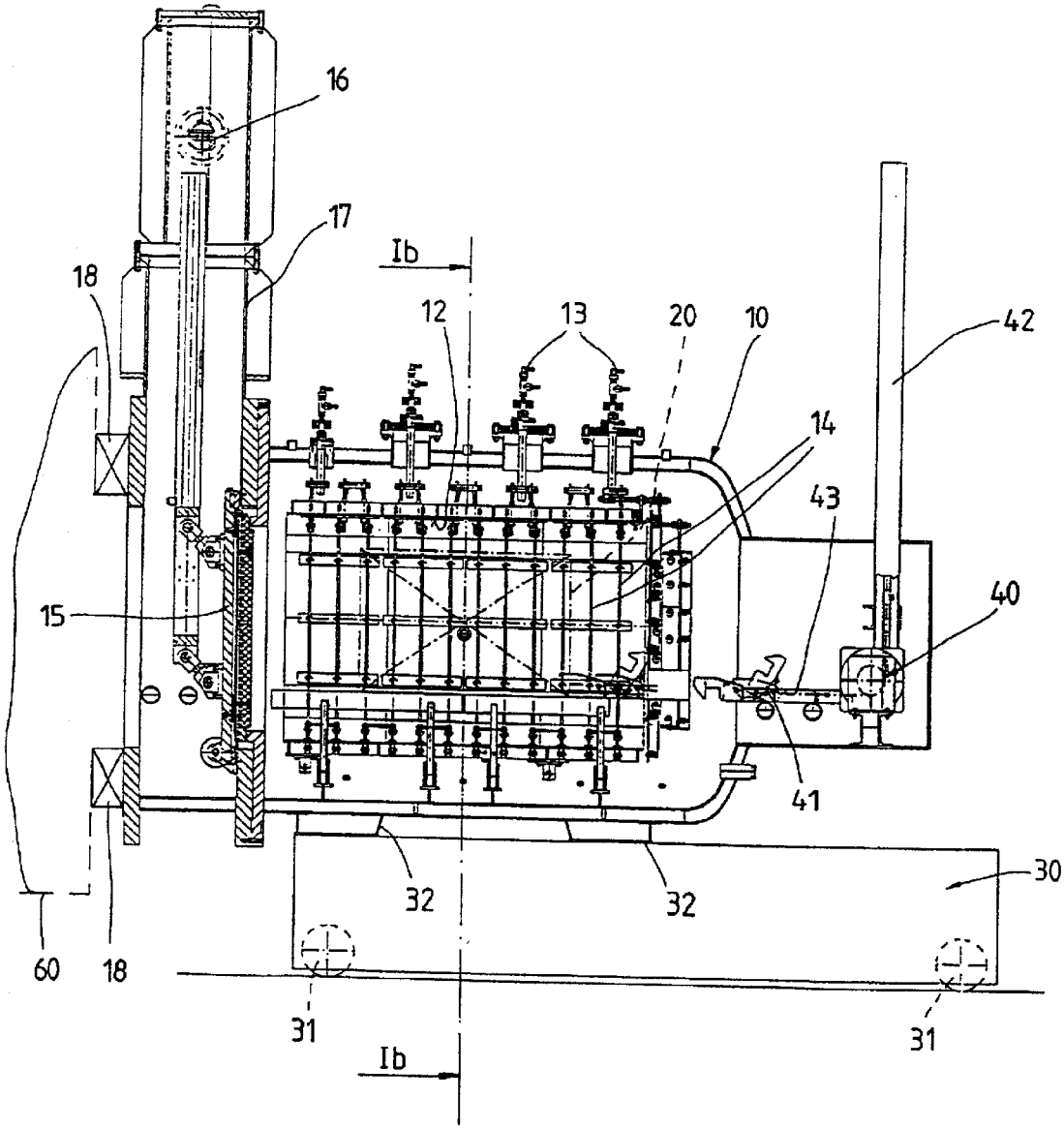
FIG. 1*a* a schematic side view of an arrangement designed for transporting metallic work pieces FIG. 1*b* a section through the line 1*b*—1*b* in FIG. 1, and FIG. 2 a schematic illustration of a system for heat treating metallic work pieces, comprising a transport arrangement similar to the arrangement shown in FIG. 1*a* and 1*b*.

The arrangement for transporting metallic work pieces 20 illustrated in FIG. 1*a* comprises a cylindrical transport chamber 10, which is heat-insulated from the outside and vacuum tight, and is designed to hold work pieces 20 that have been combined to form a batch, and transporting gear 30 that serves to move transport chamber 10. The arrangement is further equipped with means 40 for loading and unloading work pieces 20, which are equipped with a horizontally movable catch 41. Catch 41 can be moved horizontally via an electromechanical drive mechanism with a pressure chain 43 that can be moved forward and backward; the loose side of the chain is taken up in a vertically positioned receptacle 42. This serves to ensure that all starting and braking processes in the reliable transport of work pieces 20 from transport chamber 10 to a treatment chamber 50 or vice-versa will proceed gently.

Figure 1B:
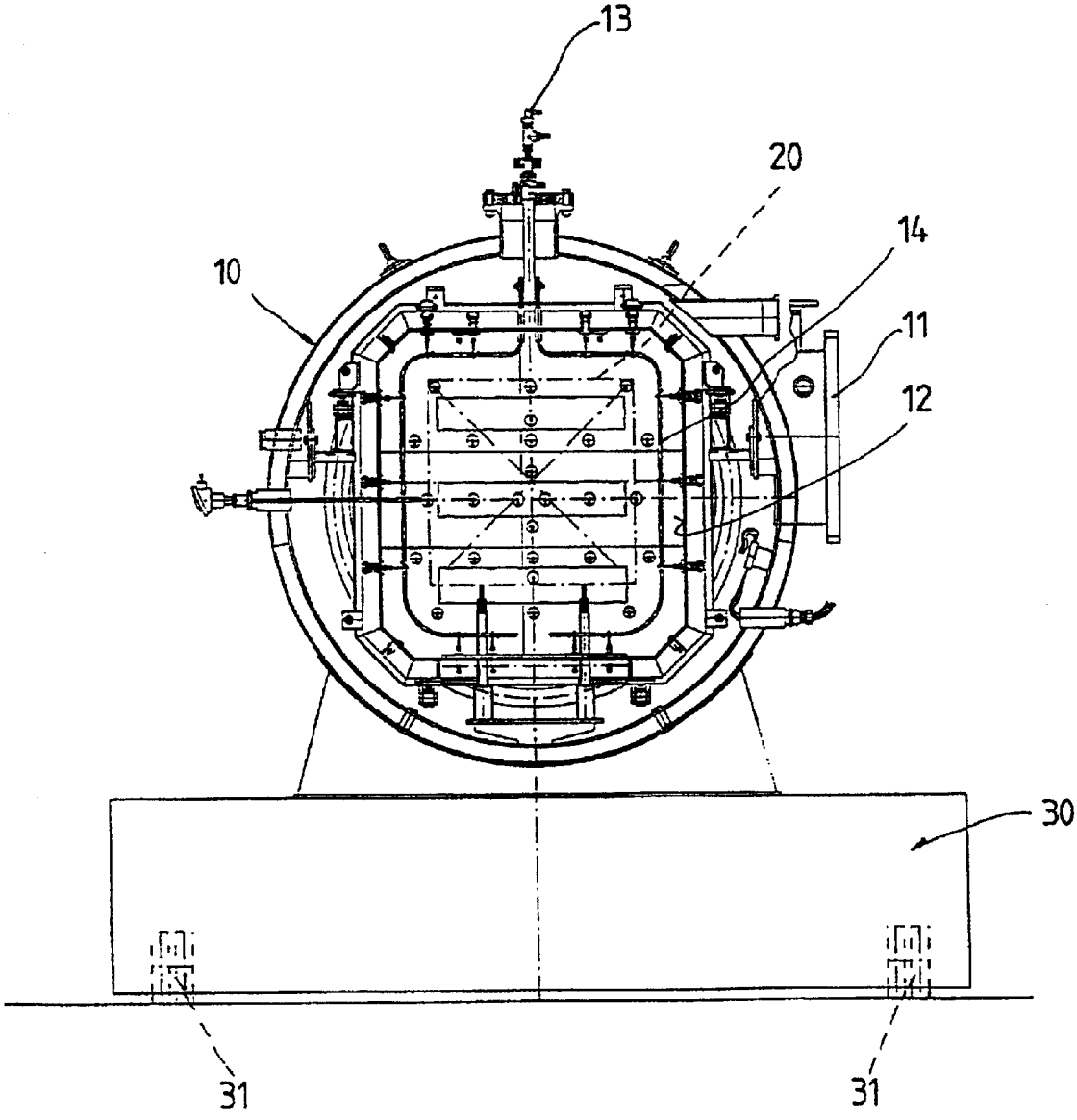

As can be seen best in FIG. 1*b*, the transport chamber 10 is equipped with a flange 11 for a vacuum pump, which is not illustrated here. Via the vacuum pump, which is fastened to transporting gear 30, it is possible to evacuate the interior of transport chamber 10 to a final pressure of approximately 0.1 mbar (=10 Pa), and to hold it at this pressure level at a leak rate of approximately 0.003 mbar 1/s. It is thus ensured that heat-treated work pieces 20 inside transport chamber 10 will be protected from environmental influences, such as an introduction of oxygen, which would result in an undesirable oxidation.

To prevent any perceptible drop in temperature of work pieces 20, which have been heated within treatment chamber 50, transport chamber 10 is provided with a removable thermal insulation 12 made, for example, of chrome nickel steel, and is further equipped with heating elements 14 that are connected to an electric power lead-through 13. Heating elements 14 ensure a heating of empty transport chamber 10 to approximately 1,000° C. within a very short time, at a control temperature of approximately ±5° C.

Transport chamber 10 is equipped at its front end with a hermetically sealable loading door 15, which can be raised vertically via a drive mechanism 16, which in the present case is hydraulically actuated, but dependent upon the specific application may be electrically or pneumatically actuated. During opening or closing, loading door 15 moves within a double-walled portal 17, with connecting devices 18 attached on the side of the portal that faces away from transport chamber 10. With these connecting devices 18, transport chamber 10 can be docked, vacuum-tight, to a transfer canal 60, which is shown here only in an outline.

Transporting gear 30 for the arrangement, which is equipped with wheels 31, is actuated via a geared motor that is driven by a frequency converter, and thus starts and brakes gently. The process speed of transporting gear 30, which is freely controllable in all directions and can rotate in place, thus permitting a positioning precision of approximately ±1 mm, amounts to only 0.01 m/s to 0.03 m/s, so that additional protective measures, such as a grid arrangement, can be dispensed with. However, safety devices are provided at the front and rear ends of transporting gear 30 that will trigger an emergency stop if an obstacle is encountered. In addition, rails 32 are positioned on transporting gear 30, via which transport chamber 10 can be moved relative to transporting gear 30 along a stretch of approximately 200 mm. Transport chamber 10 is then moved by a hydraulic cylinder that is not illustrated here.

Figure 2:
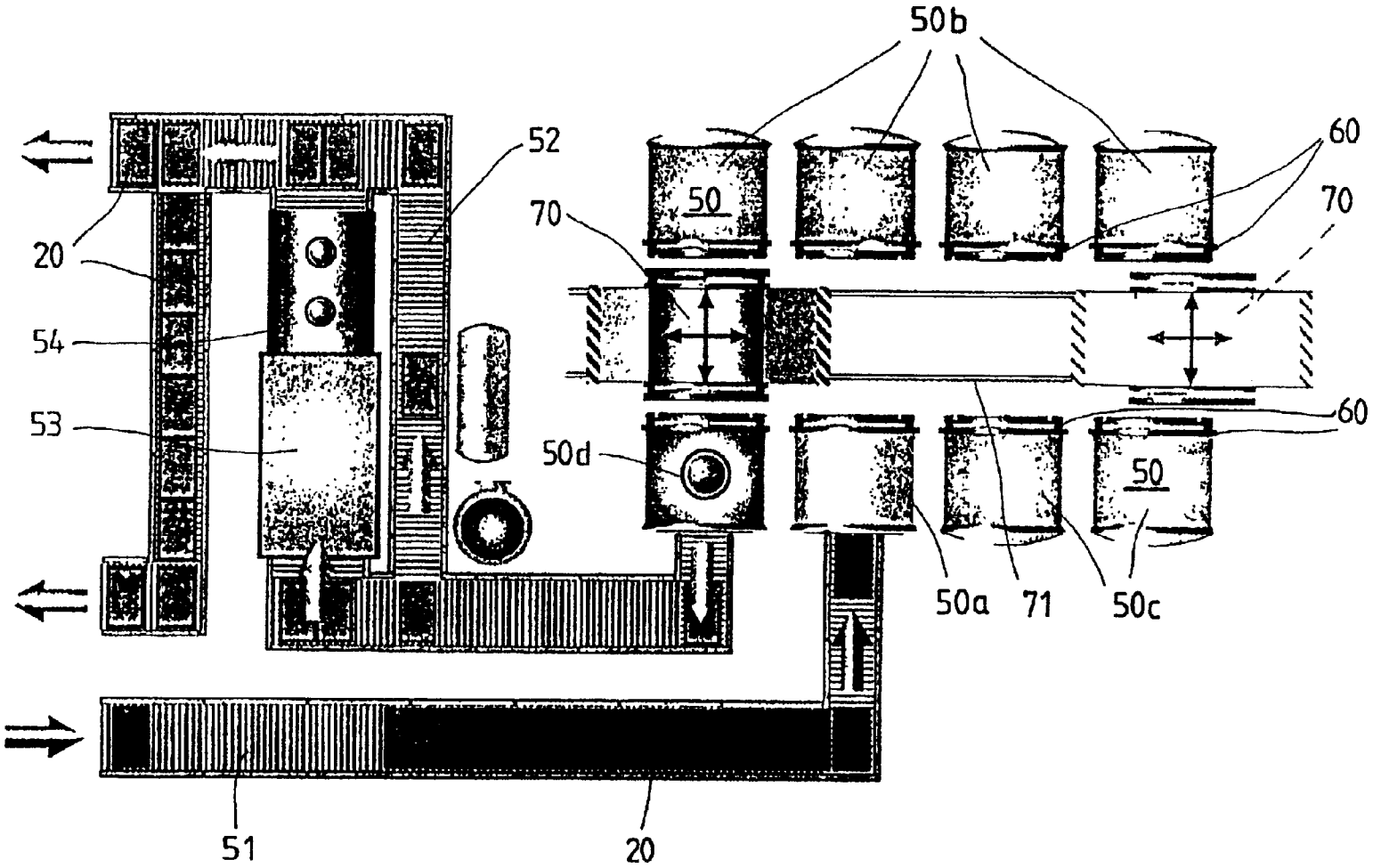

With above-described arrangement for transporting metallic work pieces 20, batches measuring 600 mm×900 mm×600 mm and having a maximum weight of 600 kg—but also batches measuring 900 mm×1200 mm×900 mm and weighing 1,000 kg, and even larger batches and smaller batches—can be flexibly and efficiently transported at temperatures of up to approximately 1,100° C. between several treatment chambers 50 in a system for heat treating metallic work pieces 20. In the illustration in FIG. 2, this type of system is shown. In this, treatment chambers 50 positioned vis-à-vis both sides of a transport arrangement 70, which corresponds to the above-described arrangement with slight modifications, are designed to comprise a vacuum-preheating chamber 50*a*, low-pressure carbonization chambers 50*b*, diffusion chambers 50*c*, and a gas quenching chamber 50*d*—or an oil or salt bath quenching chamber.

In order to transport untreated work pieces 20, which were first moved via a conveyor belt or roller belt 51 into vacuum preheating chamber 50*a*, into treatment chambers 50 that correspond to the current heat treatment process, transport chamber 10 of transport arrangement 70 is coupled to vacuum preheating chamber 50*a* via stationary transfer canal 60 that is positioned in front of each treatment chamber 50. In order to load transport chamber 10 with work pieces 20, transfer canal 60 and transport chamber 10 are evacuated of air. The doors of vacuum preheating chamber 50a and transfer canal 60, along with loading door 15 of transport chamber 10, are then opened, and work pieces 20 are loaded via the loading fork 41 into transport chamber 10. After loading door 15 has again been closed, transport chamber 10 is transported to one of low-pressure carbonization chambers 50b. Thermal insulation 13 and heating elements 14 ensure that work pieces 20 experience no drop in temperature. Upon reaching appropriate carbonization chamber 50*b*, a second door, opposite loading door 15, in transport arrangement 70, which can be moved in a straight line along rails 71, opens, and work pieces 20 are shifted through transfer canal 60 at treatment chamber 50 into carbonization chamber 50*b*, via loading fork 41.

In the further transport of work pieces 20, for example, into one of diffusion chambers 50*c* or into gas quenching chamber 50*d*, the above-described course is correspondingly repeated. Transfer canals 60, which are designed to be separately evacuated, make it possible for work pieces 20 to be transported between treatment chambers 50, like carbonization chambers 50 *b* and diffusion chambers 50*c*, that have different atmospheres, without a significant expenditure of time; this also serves to ensure that work pieces 20 are transported within the vacuum inside transport chamber 10, thus protecting them from environmental influences. Ultimately, work pieces 20 exit gas quenching chamber 50*d* via a conveyor belt 52, which, depending upon the nature of the heat treatment process, transports work pieces 20 on to a tempering furnace 53 and a subsequent cooling tunnel 54.

The arrangement for transporting metallic work pieces 20 described above, which comprises only one loading door 15 and is thus simpler in design, may also be used in the framework of the latter heat treatment system. This is based upon the fact that transporting gear 30 in this arrangement is designed to allow transport chamber 10 to rotate in place, allowing a problem-free docking with the treatment chambers 50 that are positioned opposite one another.

| References in Diagrams | |
|---|---|
| 10 | Transport Chamber |
| 11 | Flange |
| 12 | Insulation |
| 13 | Current Supply |
| 14 | Heating Element |
| 15 | Loading Door |
| 16 | Drive Mechanism |
| 17 | Portal |
| 18 | Connecting Device |
| 20 | Work Pieces |
| 30 | Transporting Gear |
| 31 | Wheel |
| 32 | Rails |
| 40 | Loading and Unloading Devices |
| 41 | Catch |
| 42 | Receptacle |
| 43 | Pressure Chain |
| 50 | Treatment Chamber |
| 50a | Vacuum Preheating Chamber |
| 50b | Low-Pressure Carbonization Chamber |
| 50c | Diffusion Chamber |
| 50d | Gas Quenching Chamber |
| 51 | Conveyor Belt/Roller Belt |
| 52 | Conveyor Belt/Roller Belt |
| 53 | Tempering Furnace |
| 54 | Cooling Tunnel |
| 60 | Transfer Canal |

-continued

| References in Diagrams | |
|---|---|
| 70 | Transport Arrangement |
| 71 | Rails |

What is claimed is:

1. An arrangement for transporting metallic work pieces, especially during a heat treatment process, comprising:

a heat-insulated transport chamber to hold the work pieces;

means for loading and unloading the work pieces; and a transporting gear for moving the transport chamber, wherein the transport chamber can be moved horizontally, is designed to be vacuum-tight, and can be evacuated of air to create a vacuum to protect the work pieces from environmental influences;

wherein the transport chamber contains a horizontal batch loading and unloading device, and wherein the transport chamber is provided with a heating element for heating the treatment chamber, and wherein the transport chamber is equipped with a removable thermal insulation made of steel.

2. The arrangement in accordance with claim 1, further comprising a vacuum pump for evacuating the air from the transport chamber.

3. The arrangement in accordance with claim 1, wherein the transport chamber is equipped with a hermetically scalable loading door, which may be actuated via a drive mechanism.

4. The arrangement in accordance with claim 3, wherein the transport chamber is equipped with a hermetically sealable connecting door.

5. The arrangement in accordance with claim 1, wherein the transport chamber and the transporting gear can be moved relative to one another.

6. The arrangement in accordance with claim 5, wherein the transport chamber is positioned on the transporting gear such that it can pivot horizontally or can move in a straight line in a horizontal and/or vertical direction.

7. The arrangement in accordance with claim 1, wherein the transporting gear can rotate in place.

8. The arrangement in accordance with claim 1, wherein the transporting gear is rail-mounted, or can be controlled freely via induction loops embedded in the base.

9. A system for boat treating metallic work pieces comprising:

at least two treatment chambers for the horizontal acceptance of batches, in which the work pieces can be heat treated; and an arrangement for transporting metallic work pieces can be coupled to the treatment chamber via a transfer canal that can be evacuated of air, the arrangement includes:

a heat-insulated transport chamber to hold the work pieces;

means for loading and unloading the work pieces; and a transporting gear for moving the transport chamber, wherein the transport chamber can be moved horizontally, is designed to be vacuum-tight, and can be evacuated of air to create a vacuum to protect the work pieces from environmental influences;

wherein the transport chamber contains a horizontal batch loading and unloading device, and wherein the transport chamber is provided with a heating element for heating the treatment chambers, and wherein the transport chamber is equipped with a removable thermal insulation made of steel.

10. The system in accordance with claim 9, wherein the transfer canal is connected to the treatment chamber in a stationary position.

11. The system in accordance with claim 9, wherein the transfer canal can be evacuated separately.

12. The system in accordance with claim 9, wherein the transfer canal is equipped with a drive mechanism, via which a loading door of the transport chamber may be actuated.

13. The system in accordance with claim 9, wherein the treatment chamber is a vacuum furnace, an atmospheric furnace, or a cooling chamber.

14. A method of transporting metallic work pieces during a heat treatment process, in which the work pieces are transported within a heat-insulated, horizontally movable transport chamber, between at least two horizontally loaded treatment chambers, in which the work pieces may be heat treated, the method comprising:

evacuating the transport chamber, which is designed to be vacuum-tight, or air, wherein the transport chamber is provided with a heating element for heating the treatment chamber, and wherein the transport chamber is equipped with a removable thermal insulation made of steel;

creating a vacuum that will protect the work pieces from environmental influences;

transporting the work pieces within the vacuum from one treatment chamber to the next; and holding the work pieces at the treatment temperature, without any significant drop in temperature.

15. The method in accordance with claim 14, further comprising coupling the transport chamber via a transfer canal to the appropriate treatment chamber.

16. The method in accordance with claim 15, further comprising evacuating the transfer canal separately.

17. The arrangement in accordance with claim 1, wherein the heating element is connected to an electrical power supply.

* * * * *